US005084694A

United States Patent [19]

Kikuchi et al.

[11] Patent Number: 5,084,694

[45] Date of Patent: Jan. 28, 1992

[54] DETECTION ELEMENTS AND PRODUCTION PROCESS THEREFOR

[75] Inventors: Toru Kikuchi; Yasuhito Yajima, both of Nagoya, Japan

[73] Assignee: NGK Insulators, Ltd., Japan

[21] Appl. No.: 542,929

[22] Filed: Jun. 25, 1990

[30] Foreign Application Priority Data

Jun. 29, 1989 [JP] Japan ..... 1-165268

[51] Int. Cl.[5] ..... H01C 1/012; H01C 3/04; H01C 1/02; H01C 1/034

[52] U.S. Cl. ..... 338/308; 338/27; 338/258; 338/262; 338/22 R; 29/610.1; 29/611; 29/612; 29/620; 427/101

[58] Field of Search ..... 338/308, 262, 258, 273, 338/274, 276, 25, 27, 22 R; 29/61.10, 611, 613, 619, 620, 621, 612; 156/659.1, 661.1; 204/192.21; 264/272.18; 427/101, 102, 103

[56] References Cited

U.S. PATENT DOCUMENTS

| | | | |
|---|---|---|---|
| 2,658,980 | 11/1953 | Weides et al. | 338/262 |
| 3,808,575 | 4/1974 | Brandt et al. | 338/262 |
| 3,887,893 | 6/1975 | Brandt et al. | 338/262 |
| 4,069,465 | 1/1978 | Kouchich et al. | 338/274 X |
| 4,903;001 | 2/1990 | Kikuchi | 338/22 R |

*Primary Examiner*—Marvin M. Lateef
*Attorney, Agent, or Firm*—Parkhurst, Wendel & Rossi

[57] ABSTRACT

A detection element including a cylindrical base body, an electric resistor formed on an outer peripheral surface of the base body, and lead wires attached to ends of the base body. The lead wires are electrically connected to the electric resistor. An electrically thick film is provided over end faces of the base body, an inner peripheral surface and an outer peripheral surface of the base body near each of the opposite ends of the base body, and the lead wires are electrically connected to the resistor at least through the electrically conductive thick film. A process for producing such a detecting element including forming an electric resistor on an outer periphery of a cylindrical base body; coating a paste onto end faces of the base body and inner and outer peripheral surfaces of the base body near each of the end faces; forming the electrically conductive thick film electrically connected to the electrical resistor by firing the electrically conductive thick film-forming paste; and fixing the lead wires to the end portions of the base body and forming electrically conductive portions where the lead wire is electrically connected to the electrically conductive thick film.

7 Claims, 5 Drawing Sheets

FIG_9a
PRIOR ART
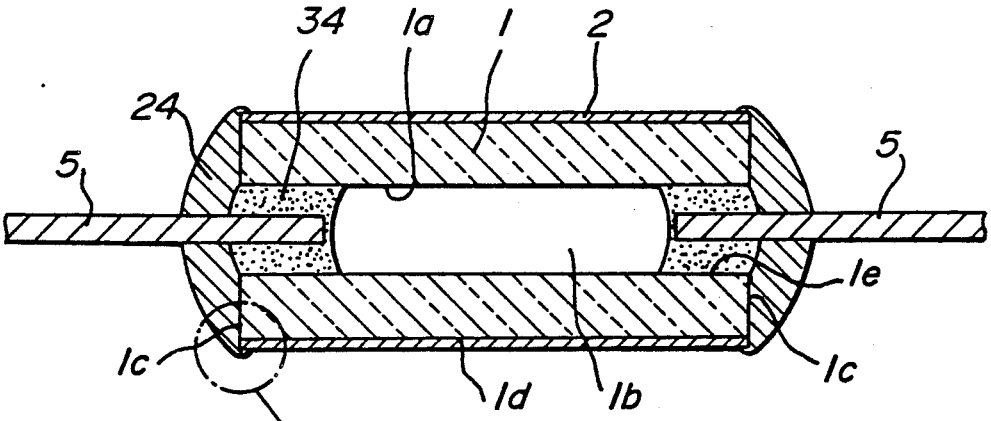
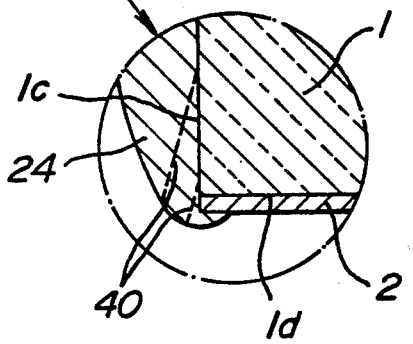
FIG_9b
PRIOR ART
FIG_10
PRIOR ART
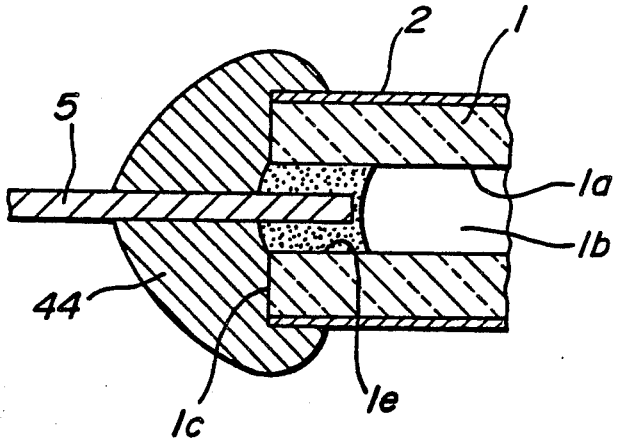

DETECTION ELEMENTS AND PRODUCTION PROCESS THEREFOR

BACKGROUND OF THE INVENTION

1. Field of the Invention

The present invention relates to detection elements for measuring physical properties (flow amount, flow rate, etc.) of fluids by utilizing heat exchanging or heat transmission phenomenon. The invention also relates to a process for producing the same.

2. Related Art Statement

For example, a detection element is formerly known as a sensor for measuring the flow amount of sucked air as shown in FIG. 9. Such a detection element is produced as follows:

First, a thin film 2 made of platinum, nickel or the like is formed as a resistor on the outer surface of a cylindrical base body, for example, of a cylindrical long alumina pipe by a physical or chemical means such as vapor deposition, plating or sputtering, and this long alumina pipe is cut to a given length as shown in FIG. 9. Then, tip portions of metallic lead wires 5 are inserted into a hollow space 1*b*, and are fixed to the alumina pipe 1 with a platinum paste 24 and a glass paste 34 (only the platinum paste may be used).

The platinum paste layer 24 is provided on an end face 1*c* of the alumina pipe 1, and fixed to the metallic lead wire 5. On the other hand, as shown in an enlarged view of FIG. 9(*b*), since an end portion of the platinum paste layer 24 contacts the electrical resistor layer 2, the metallic lead wires 5 are electrically connected to the electric resistor layer 2.

However, since the end face 1*c* of the alumina pipe 1 is formed in such a conventional detection element by cutting, this cut end face 1*c* and the outer peripheral surface 1*d* forms an acute right angle. Accordingly, when the platinum paste layer 24 is fired, crack lines 40 grow as shown by broken lines at an end portion of the platinum paste layer 24 because of firing shrinkage. Consequently, electrical conduction becomes poor, and an adverse effect (increased variations in temperature coefficient of resistance and decreased temperature coefficient of resistance) occurs in terms of a temperature coefficient of resistance (T.C.R.) of the detection element.

In order to prevent such poor electrical conduction, a detection element is proposed, in which a platinum paste layer 44 is greatly heaped in lateral and vertical directions as shown in FIG. 10. However, in this case, a connection between the lead wire 5 and the alumina pipe 1 becomes so bulky that heat capacity of the detection element becomes greater to lower the response speed or the like.

SUMMARY OF THE INVENTION

It is an object of the present invention to provide a detection element which can maintain electric conduction between lead wires and an electrical resistor, prevent adverse effects upon the T.C.R., suppress increase in heat capacity of the detection element, and maintain good response.

The present invention is characterized in that the detection element comprises a cylindrical base body, an electric resistor formed on an outer peripheral surface of the base body, and lead wires attached to ends of the base body, the lead wires being electrically connected to the electric resistor. An electrically conductive thick film is also provided over each of end faces of the base body, and inner and outer peripheral surfaces of the base body near the end faces, and the lead wires are electrically connected to the resistor at least through the electrically conductive thick film.

The present invention is further characterized in that a process for producing a detecting element comprises the steps of: forming an electric resistor on an outer periphery of a cylindrical base body; coating a paste onto end faces of the base body and inner and outer peripheral surfaces of the base body near each of the end faces of the base body, said paste being to form an electrically conductive thick film; forming the electrically conductive thick film electrically connected to the electrical resistor by firing the electrically conductive thick film-forming paste; and fixing the lead wires to the end portions of the base body and forming electrically conductive portions where the lead wire is electrically connected to the electrically conductive thick film.

In the present invention, the electrically conductive thick film means a thick film having an electrical conductivity great enough to electrically connect the electric resistor with the lead wire. The thickness of the thick film is preferably 3–80 μm, and more preferably 5–50 μm.

That the electrically conductive thick film is provided on the outer peripheral surface of the base body means both a case where the electrically conductive thick film is directly provided on the outer peripheral surface of the base body and a case where the electrical conductive thick film is formed on the outer peripheral surface of the base body through a given layer (for example, an electrically resistive layer). This is also applicable to the provision of the thick film on the inner peripheral surface of the base body and on the end face of the base body.

These and other objects, features and advantages of the invention will be appreciated upon reading the following description of the invention when taken in conjunction with the attached drawings, with the understanding that some modifications, variations and changes of the same could be made by the skilled person in the art to which the invention pertains without departing from the spirit of the invention or the scope of claims appended hereto.

BRIEF DESCRIPTION OF THE DRAWING

For a better understanding of the invention, reference is made to the attached drawings, wherein:

FIG. 9 is a sectional view of the conventional detection element; and

FIG. 10 is a partially sectional view of another conventional detection element.

DETAILED DESCRIPTION OF THE INVENTION

Figure 1:
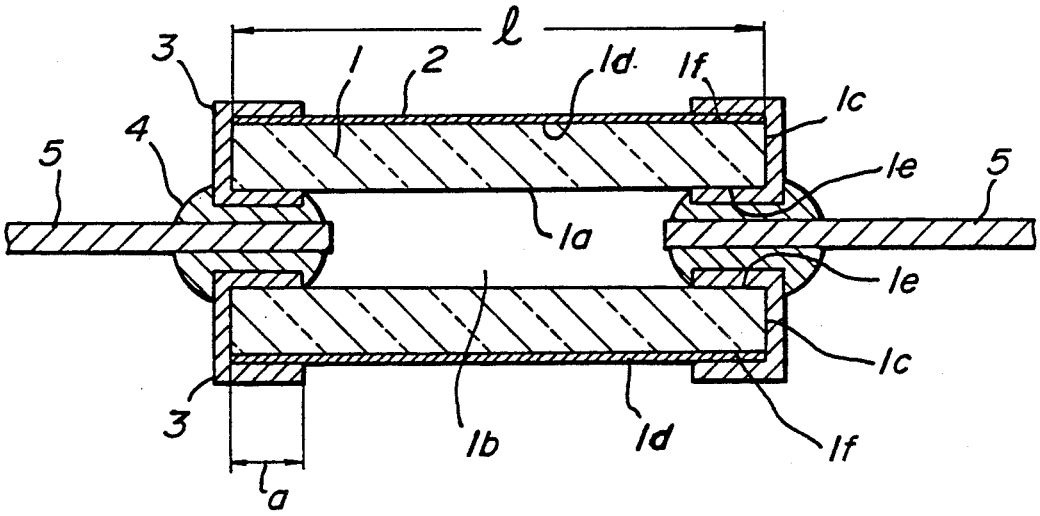
FIG. 1 is a sectional view of a detection element according to the present invention.
Figure 2:
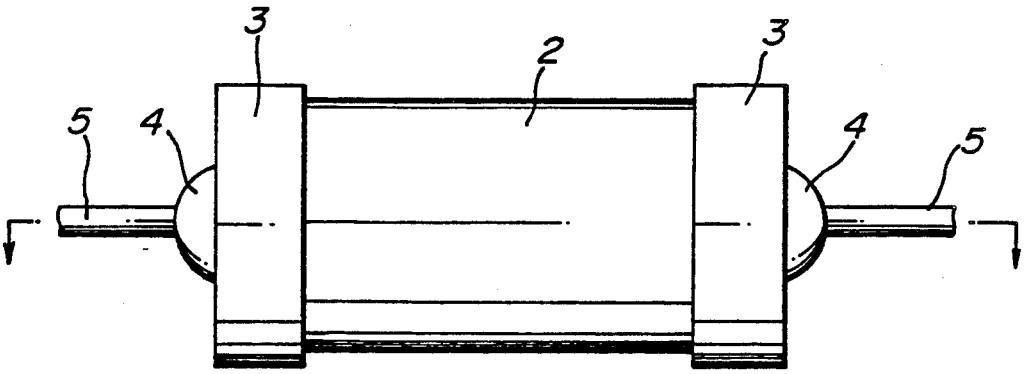
FIG. 2 is a plane view of the detection element of FIG. 1.

FIG. 1 is a sectional view of one embodiment of the detection element according to the present invention, which corresponds to a sectional view taken along a line I—I in FIG. 2. FIG. 2 is a plane view of this embodiment.

In the illustrated embodiment, a thin electrical resistor 2 is formed on the outer peripheral surface of a cylindrical alumina pipe 1. The resistor is made of platinum, nickel, rhodium, paradium or the like and is formed by a physical or chemical process such as sputtering, CVD, vapor deposition or plating. In this case, after the thin film 2 is formed on the long alumina pipe, the pipe is cut to a given length 1 as shown in FIG. 1. Alternatively, it may be that a long cylindrical pipe is cut, and then a thin electrical resistor 2 is provided on the cut alumina pipe. In the latter case, electrical conduction is conventionally poor at contact line between the cut face and the outer peripheral surface of the cylindrical alumina pipe 1.

Next, a thick electrically conductive film 3 having a thickness of 3–80 μm is formed on an end face 1*c* of the cylindrical alumina pipe 1, on a portion 1*e* (the end portion of the inner peripheral surface) near the end face of the inner periphery 1*a*, and on a portion 1*f* (the end portion of the outer peripheral surface) near the end face of the outer periphery 1*d* through the thin electrical resistor 2. The thick electrically conductive film 3 is formed by coating the surface of the alumina pipe 1 with a platinum paste, a gold paste, a nickel paste, a platinum-rhodium alloy paste or the like, and firing it. This forming process will be explained later.

Next, a tip of a metallic lead wire 5 is inserted into an end portion of a hollow space 1*b*, and the tip of the lead wire 5 is fixed to the end portion of the hollow space with an electrically conductive paste 4 (for example, platinum-glass paste) having the same composition as that of the paste for the formation of the electrically conductive thick film 3. By so doing, electrical connection from the metallic lead wire to the thin electric resistor 2 is assured through the conductive layer 4 and the electrically conductive thick film 3.

Then, the surface of the structural body shown in FIGS. 1 and 2 is coated with a protective layer made of inorganic glass (not shown).

Figure 3:
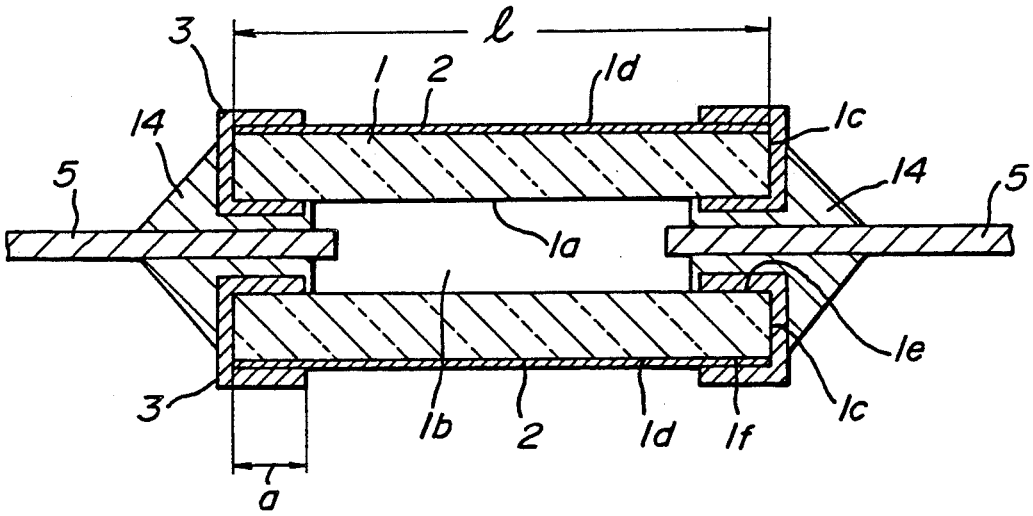
FIG. 3 is a sectional view of another detection element according to the present invention.

In FIG. 3 is shown a detection element which has almost the same construction as that shown in FIG. 1, but the electrical conductive portion 14 has a sectional shape acutely projecting outwardly around a metallic lead wire 5.

In FIGS. 1 and 3, the composition of the paste for the formation of the electrically conductive thick film 3 is not necessarily the same as that of the paste for the electrically conductive portion 14. The kinds of the pastes may appropriately be selected.

According to the above-mentioned detection elements, since the electrical conduction is assured by providing the electrically conductive thick film over the end face of the cylindrical alumina pipe and the end portion of the outer periphery, the thickness of the electrically conductive thick film has a relatively uniformly greater thickness of 3–80 μm, and preferably 5–50 μm at the right angle boundary between the end face and the end portion of the outer periphery. Consequently, there is no possibility that crack occurs there during firing to cause poor electrical conduction. Thus, variation or lowering in the T.C.R. will not occur.

The reason why the thickness is set in a range from 3–80 μm is that if the thickness is less than 3 μm, it is difficult to assure the electrical conduction at the right angle portion, while if it is more than 80 μm, the paste for the formation of the electrically conductive thick film greatly shrinks in a direction parallel to the coated face, so that cracks are likely to occur there. As a matter of course, since it is no need to heap the electrically conductive paste in a great thickness as in the conventional technique, the heat capacity does not become great, and good response can be maintained. The thick film is not formed by heaping the paste, but it has a relatively uniform thickness. Therefore, the volume and heat capacity can be made smaller.

In addition, since the electrical conductive thick film is formed over the end face and the end portion of the inner periphery of the cylindrical alumina pipe, the metallic lead wire can easily be fixed by providing the electrically conductive portion between the metallic lead wire and there. Particularly, as shown in FIG. 1, the volume of the electrical conductive portion can be suppressed smaller.

In FIGS. 1 and 3, the length "a" of the electrically conductive thick film formed on the outer peripheral surface and the inner peripheral surface of the base body is preferably not more than 10%, and more preferably not more than 5% of the entire length "l" of the alumina pipe. In order to assure the electrical conductivity, the length "a" is preferably twice or more as great as that of the electrically conductive thick film.

Next, the process for forming the electrically conductive thick film will further be explained.

Figure 4:
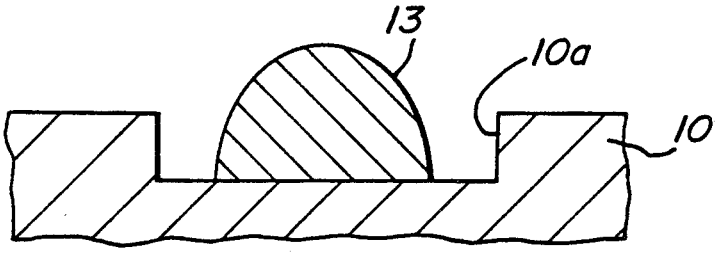
FIG. 4 is a sectional view illustrating a case where a paste for the formation of an electrically conductive thick film is placed in a recess formed in a metallic plate.
Figure 5:
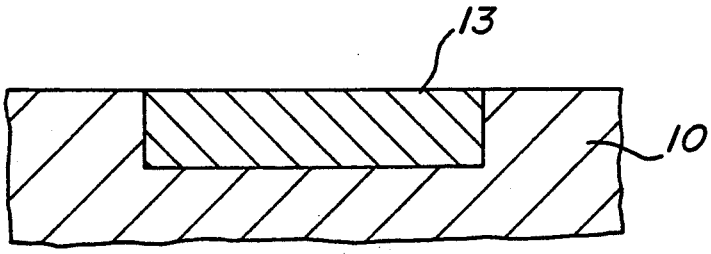
FIG. 5 is a sectional view illustrating a case where the electrically conductive thick film-forming paste is flattened at the surface thereof.

First, as shown in FIG. 4, a recess 10*a* is formed in a metallic plate 10 in a depth of 10–30 μm. A paste 13 for the formation of an electrically conductive thick film is placed in the recess, and the surface of the paste 13 is flattened by a plastic flat plate or the like (not shown) as shown in FIG. 5.

The paste for the electrically conductive film is preferably prepared by kneading a metallic powder made of platinum, rhodium, gold, platinum-rhodium or the like preferably with a glass powder in addition to an organic binder and an organic solvent by means of a triroll mill, a ball mill or the like, and adjusting the kneaded material to an appropriate viscosity with further addition of an organic solvent.

Figure 6:
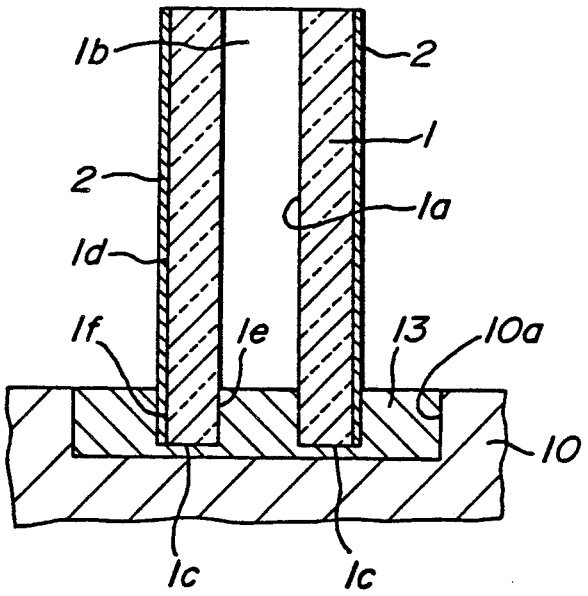
FIG. 6 is a sectional view illustrating a case where an end of a cylindrical alumina pipe is buried into the thick film-forming paste.
Figure 7:
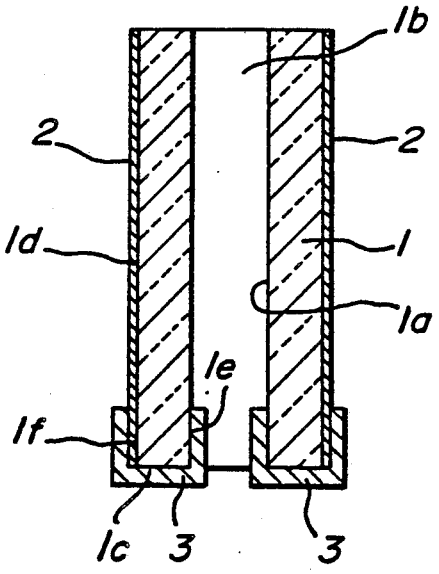
FIG. 7 is a sectional view of the cylindrical alumina pipe pulled up.

Next, as shown in FIG. 6, one end portion of the alumina pipe 1 which has the outer peripheral surface 1*d* coated with a thin electrical resistor is buried into the paste 13. Then, when the alumina pipe 1 is pulled up, the paste for the formation of the electrically conductive thick film is attached onto the end face 1*c*, the end portion 1*f* of the outer periphery surface and the end portion 1*e* of the inner periphery of the alumina pipe. The electrically conductive thick film 3 shown in FIG. 7 is formed by firing the paste.

Figure 8:
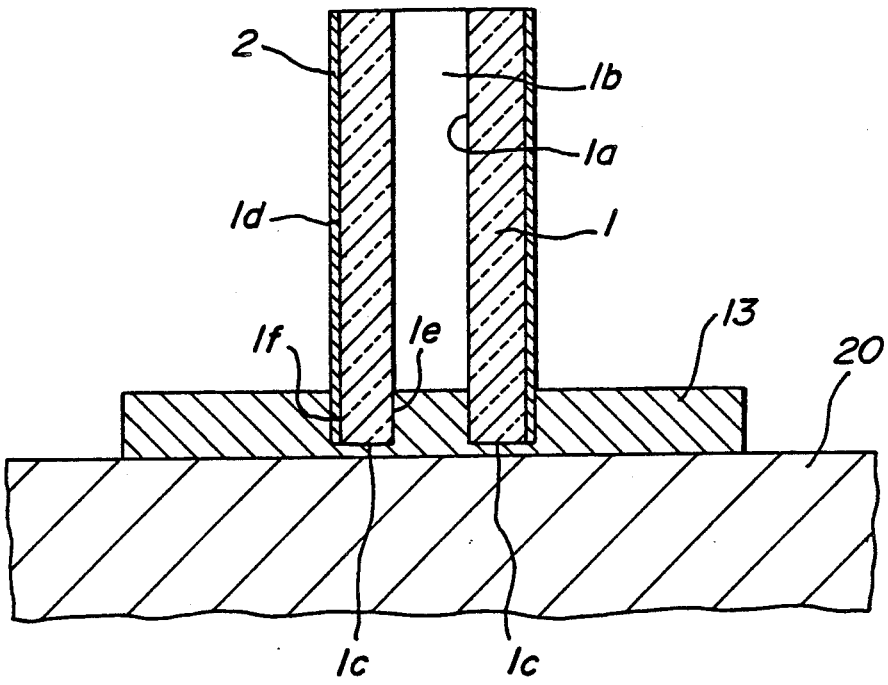
FIG. 8 is a sectional view illustrating a case where an end portion of a cylindrical alumina pipe is buried into a paste layer for the electrically conductive thick film.

As shown in FIG. 8, it may be that the paste 13 for the formation of the electrically conductive thick film is placed on the surface of the metallic flat plate 20, the surface of the paste is flattened, and one end of the alumina pipe 1 is buried therein as in the same manner shown in FIG. 6.

According to the above processes, the electrically conductive thick film 3 can be formed on the end portion of the small alumina pipe having the outer diameter of about 0.5 mm with good productivity. Further, the magnitude of the thickness "a" shown in FIGS. 1 and 3 can easily be controlled by varying the depth (thickness) of the paste 13 for the formation of the thick film.

In the embodiments mentioned above, for example, a rectangular column, a hexagonal column or the like may be employed as the shape of the alumina pipe instead of the cylindrical one. Further, mullite, zirconia, quartz, glass or the like may be used as a material for the base portion instead of alumina.

The thin resistor may uniformly be formed over the entire outer peripheral surface of the cylindrical base body. The resistor may spirally be formed by laser trimming.

In the following, more specific examples will be explained.

First, a long cylindrical alumina pipe having an outer diameter of 0.5 mm, an inner diameter of 0.2 mm and a length of 20 mm was prepared, and the outer peripheral surface of the long cylindrical lumina pipe was plated with platinum in a thickness of 0.1 μm. Then, the alumina pipe was cut into pieces each having a length of 2 mm.

Next, a material having the following composition was kneaded for 1 hour by a triroll mill, and a platinum paste was prepared by adjusting the viscosity of the kneaded material to 5000 cp.

platinum powder (grain size: 1 μm); 100 parts by weight
glass powder (firing temp.: 900° C., 325 meshes); 5 parts by weight
organic binder (ethyl cellulose); 5 parts by weight
organic binder (butylcarbitol); appropriate amount Next, a recess was provided in a metallic plate as shown in FIG. 4 in a depth of 30 μm, and the above metallic paste was placed in the recess. As shown in FIG. 5, the surface of the metallic plate was flattened, and an end portion of the above cylindrical alumina pipe was buried therein as shown in FIG. 6. Then, a paste for the electrically conductive thick film was attached to an end faces, and end portions of inner and outer peripheral surfaces of the alumina pipe, followed by drying. Further, the paste for the electrically conductive thick film was similarly attached to the opposite end portion of the alumina pipe, followed by drying. The paste thus attached was fired at 900° C. to form a uniform electrically conductive thick film in a thickness of about 8 μm as shown in FIG. 7 (only one end is shown).

Thereafter, a tip portion of a lead wire made of stainless steel was inserted into an end portion of a hollow space as shown in FIGS. 1 and 3. Next, a paste having the same composition as that of the platinum paste was applied between the lead wire and the electrically conductive thick film, followed by drying and firing at 900° C. Thereby an electrically conductive portion 4 was formed as shown in FIGS. 1 and 3.

Then, the entire detection element was covered with a protective layer made of an inorganic glass.

Table 1 shows results of stability in electrical conductivity and response when the thickness of the thick layer and the covering depth "a" in the alumina pipe were varied in the case that the above paste was used.

TABLE 1

| | | | Thick film | | | Response |
|---|---|---|---|---|---|---|
| | No. | Shape | Thickness (μm) | a (μm) | State of right angle portion | time (msec) |
| Example | 1 | FIG. 1 | 4 | 30 | good | — |
| | 2 | " | 10 | 50 | " | 80 |
| | 3 | " | 50 | 110 | " | — |
| | 4 | FIG. 3 | 20 | 100 | " | — |
| | 5 | " | 40 | 100 | " | 90 |
| | 6 | " | 60 | 150 | " | — |
| Comparative Example | 7 | FIG. 9 | not provided | not provided | Three of five cracked | 120 |
| | 8 | FIG. 10 | not provided | not provided | One of five surface-cracked | 150 |

While the thickness of the inorganic glass protective layer was set at 30 μm on the average, a response time was measured. Five samples were used for each case, and the average value was measured.

As the response time was shown a time required for changing the resistance of the resistor by a given value when the temperature of air was changed from 25° C. to 70° C. in the case that the flow rate of air as a gas to be measured was set at 30 kg/hour. More specifically, when a difference between $R_{70}$ and $R_{25}$ was taken as $\Delta R$ in which $R_{25}$ and $R_{70}$ were resistance (20 Ω and a constant value) at temperatures of 25° C. and 70° C., respectively, a time required for the resistance to increase from $R_{25}$ by $0.8 \times \Delta R$ when the temperature was changed from 25° C. to 70° C.

From the above, it is seen that a portion at a right angle portion between an end face and an outer peripheral surface is not cut or cracked during firing according to the present invention. Further, it is also seen that better response can be obtained due to smaller heat capacity.

According to the detection element in the present invention, the electrically conductive thick film is formed over the end face and the outer peripheral surface near the end face of the cylindrical base body, and the lead wire is electrically connected to the electric resistor through this electrically conductive thick film. Accordingly, since the thick film is present at the right angle portion between the end face and the end portion of the outer peripheral surface, the right angle portion will not be cut or cracked on firing to deteriorate electrical conductivity therebetween. Therefore, variations or lowering in the T.C.R. of the detection element will not be induced. Thus, since the electric conduction need not be attained by heaping the electrically conductive paste, heat capacity does not increase, and good response can be maintained. In addition, since the electrically conductive thick film is formed on the end face and the inner peripheral surface near the end face of the base body, the lead wire can easily be fixed by providing the electrically conductive portion among the end face, the inner peripheral surface near the end face of the base body and the lead wire. Further, the volume of the electrically conductive portion can be suppressed.

According to the process for producing the detection element of the present invention, the electrically conductive thick film-forming paste is attached to the base body over the end face and the inner and outer peripheral surfaces near the end face of the base body, the electrically conductive thick film is formed by firing the paste, and the lead wire is electrically connected to the electrically conductive thick film through the electrically conductive portion. Thus, the detection element according to the present invention in which the lead wires are electrically connected to the electric resistor through the electrically conductive thick film can finally be obtained.

What is claimed is:

1. A detection element, comprising:

a cylindrical base body having a first end and a second end;

a thin-film electrical resistor layer formed on an outer peripheral surface of said cylindrical base body, said thin-film electrical resistor layer providing an uninterruptable path for electrical conduction between said first end and said second end of said cylindrical base body;

an electrically conductive thick-film provided on each end of said cylindrical base body, said thick film covering end faces of said cylindrical base body and inner and outer peripheral surfaces of said cylindrical base body near each end thereof; and lead wires electrically connected to said thin-film electrical resistor layer at least via said thick-film;

wherein said thick film has a substantially uniform thickness which is greater than that of said thin-film electrical resistor layer, and a length of said thick-film provided on the outer peripheral surface of said cylindrical base body is not more than 10% of an entire length of said cylindrical base body.

2. The detection element of claim 1, wherein said detection element measures physical properties of fluids by utilizing heat exchanging or heat transmission phenomenon.

3. The detection element of claim 1, wherein said thick-film has a thickness of about 3–80 μm.

4. The detection element of claim 1, further comprising an electrically conductive member arranged between said lead wires and said thick-film, said electrically conductive member being made of the same material as that of said thick-film.

5. A process for producing a detection element, comprising the steps of:

providing a cylindrical base body having a first end and a second end;

forming a thin-film electrical resistor layer on an outer peripheral surface of said cylindrical base body such that said thin-film electrical resistor layer provides an uninterruptable path for electrical conduction between said first end and said second end of said cylindrical base body;

coating a paste onto each end face of said cylindrical base body and on inner and outer peripheral surfaces of said cylindrical base body near each end thereof;

firing the coated paste to form an electrically conductive thick-film at each end of said cylindrical base body, said thick-film being electrically connected to said thin-film electrical resistor layer;

disposing lead wires in each end of said cylindrical base body via an electrically conductive paste; and fixing said lead wires to each end of said cylindrical base body by firing said electrically conductive paste and thereby electrically connecting said lead wires to said electrically conductive thick-film;

wherein said coated paste which provides said electrically conductive thick-film is applied to each end of said cylindrical base body such that when fired said paste provides said electrically conductive thick-film having a substantially uniform thickness which is greater than a thickness of said thin-film electrical resistor layer, and a length of said thick-film which is coated on the outer peripheral surface of said cylindrical base body is not more than 10% of an entire length of said cylindrical base body.

6. The process of claim 5, wherein said coated paste is applied to each end of said cylindrical base body in such a manner so that when fired said coated paste provides said electrically conductive thick-film with a thickness of 3–80 μm.

7. The process of claim 7, wherein said electrically conductive paste is made of the same material as that of said electrically conductive thick-film.

* * * * *